United States Patent [19]

Takenoya et al.

[11] Patent Number: 4,603,988

[45] Date of Patent: Aug. 5, 1986

[54] ATTACHING DEVICE FOR A PLATEN BODY IN A PRINTER

[75] Inventors: Hideaki Takenoya; Fumiyuki Mishima, both of Tokyo, Japan

[73] Assignee: Janome Sewing Machine Co., Ltd., Tokyo, Japan

[21] Appl. No.: 618,212

[22] Filed: Jun. 7, 1984

[30] Foreign Application Priority Data

Jun. 17, 1983 [JP] Japan ..... 58-92113[U]

[51] Int. Cl.[4] ..... B41J 27/02

[52] U.S. Cl. ..... 400/649; 400/662; 400/660; 400/470

[58] Field of Search ..... 400/185, 188, 320, 320.1, 400/355, 358, 470, 471, 471.1, 648, 649, 654, 655, 657, 660, 660.1, 660.2, 660.3, 662; 101/93.21, 108

[56] References Cited

U.S. PATENT DOCUMENTS

| | | | |
|---|---|---|---|
| 1,562,109 | 11/1925 | Malcher | 400/654 |
| 1,603,790 | 10/1926 | Nelson | 400/649 |
| 3,995,547 | 12/1976 | Shimodaira et al. | 400/212 |
| 4,210,917 | 7/1980 | Lane, III | 400/470 |
| 4,310,256 | 1/1982 | Inoue | 400/320 |
| 4,347,009 | 8/1982 | Brown | 400/568 |
| 4,386,861 | 6/1983 | Kurihara et al. | 400/470 |

FOREIGN PATENT DOCUMENTS

| | | | |
|---|---|---|---|
| 57-207077 | 12/1982 | Japan | 400/655 |
| 58-112772 | 7/1983 | Japan | 400/655 |

OTHER PUBLICATIONS

*IBM Technical Disclosure Bulletin*; F. R. Humphreys; "Color Wheel w/Inked Platens"; vol. 25, No. 4, p. 2193; Sep. 1982.

*Xerox Disclosure Journal*; H. E. Smith et al; "Timing Belt Platen Drive"; vol. 8, No. 1, pp. 69–70; Jan./Feb. 1983.

*Primary Examiner*—Edgar S. Burr

*Assistant Examiner*—David A. Wiecking

*Attorney, Agent, or Firm*—Michael J. Striker

[57] ABSTRACT

In a printer which guides a printing paper between a printing head and a platen having ink containing bodies, and prints on said paper by pressure of the printing head; an attaching device for a platen body of the printer, wherein rotation control of the platen for changing ink color is made via a square shaft which is provided independently of a platen shaft having a rotatable, slidable plurality of bodies containing inks of different colors, and the platen is laterally moved via a supporter which slides along the square shaft, and the platen body comprising the platen and the platen shaft is structured independently of said rotation control and said lateral movement.

3 Claims, 2 Drawing Figures

ATTACHING DEVICE FOR A PLATEN BODY IN A PRINTER

FIELD OF THE INVENTION

This invention relates to a printer, and more particularly to an attaching device for a platen body thereof.

According to the invention, the platen body is divisible in lateral movement as well as in changing colors of inks of a platen.

BACKGROUND OF THE INVENTION

The printer is fed with a printing paper between a printing head and a platen which comprises a plurality of ink containing bodies, and carries out printing by pressure of the printing head.

Unfortunately, after using for a long period of time, the ink in the ink containing bodies is used up, or its surface is worn out by impact of the printing head, so that printing ability is lowered. In such a case, the ink containing body should be replaced, or one set of the platen be exchanged. In the latter, if the platen is of the type which is furnished with the plurality of the bodies containing different inks on its outer circumference, and is laterally moved in the same direction as the printing head, wherein the color is exchanged by rotation control of the platen, and if said two controls of the platen, i.e., the lateral movement and changing the color ink, are carried out directly to the platen and are indivisible, it is difficult to exchange the platen solely, and therefore these control systems are necessarily disassembled and readjusted when the platen is exchanged.

SUMMARY OF THE INVENTION

With respect to the printer which is fed with the paper to be printed between the printing head and the platen comprising the ink containing bodies, and carries out the printing by pressure of the printing head, and where the platen is furnished with the plurality of the bodies containing the different inks on its outer circumference and is laterally moved in the same direction as the printing head, and the color is exchanged by rotation control of the platen, the present invention makes the platen and said two control systems divisible, so that one set of the platen is exchanged independently of the two control systems and without disassembling and readjusting thereof.

The present invention will be explained in reference to the attached drawings.

DETAILED DESCRIPTION OF THE PREFERRED EMBODIMENTS

In the following explanation, rotating directions are seen from the right side in FIG. 1, and the rotation in a clockwise direction is hereinafter indicated with "CW" and the rotation in a counterclockwise direction is hereinafter indicated with "CCW", and the left side and the right side are also referred to with reference to FIG. 1.

Figure 1:
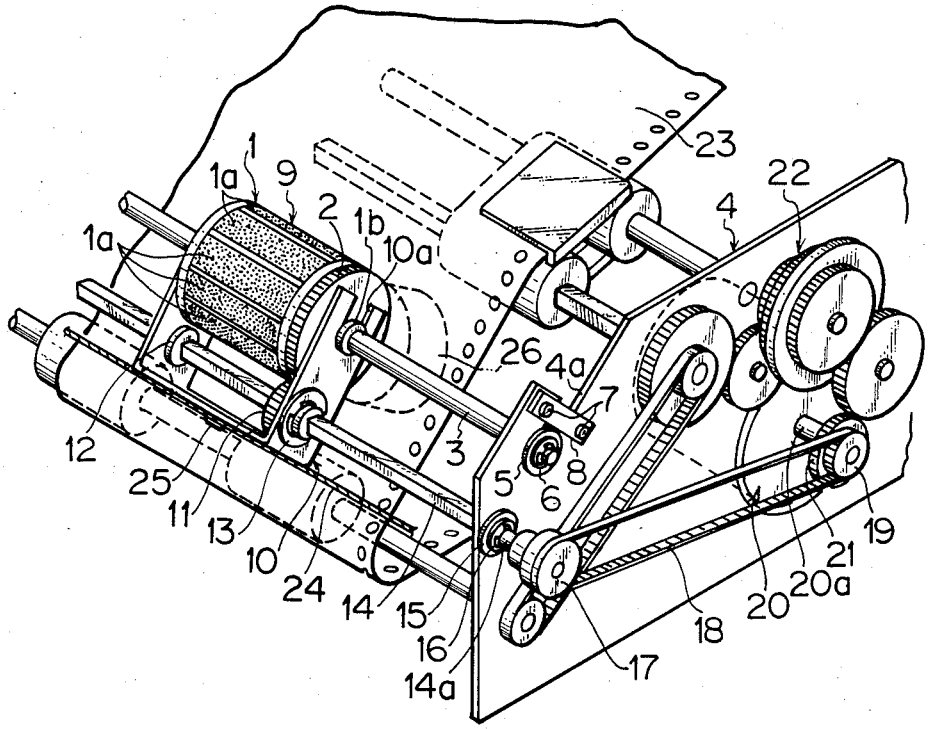
FIG. 1 is a perspective view of a main part of the printer, in accordance with the present invention
Figure 2:
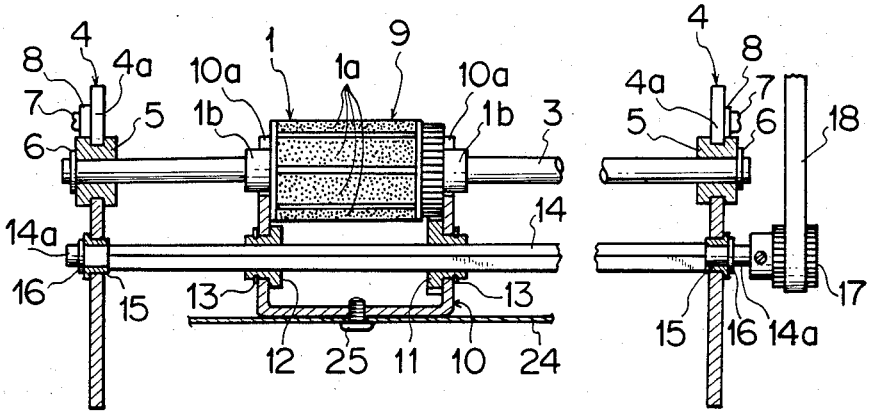
FIG. 2 is a cross sectional view showing an attaching structure of the platen and members therearound according to the present invention.

In FIGS. 1 and 2, a platen 1 is provided with a plurality of bodies 1*a* respectively containing inks of varying colors, and is provided with a gear 2 at its one end. The gear 2 is given an eye-mark (not shown) to show a constant relation of rotation phase of the ink containing body 1*a*. The platen 1 is rotatably and slidably mounted on a platen shaft 3 via a boss 1*b*.

The platen 1 is thrust-stopped by stopper rings 6, via bushings 5, in a pair of upwardly opening grooves 4*a* formed in a frame 4. The bushings 5 are checked from releasing upwardly by plates 8 fixed to the frame 4 by screws 7. A platen body 9 is composed of the platen 1, platen shaft 3, bushings 5 and stopper rings 6.

A supporter 10 is formed with a pair of grooves 10*a* opening in the same direction as said grooves 4*a*, and the platen 1 is positioned in the grooves 10*a* via the bosses 1*b*. The supporter 10 is provided with a gear 11 for a gear 2 of the platen 1 and a metal piece 12, and the gear 11 and the metal piece 12 are thrust-stopped by a pair of stopper rings 13 and are rotated with respect to the supporter 10 by a square member 14 passing therethrough. The gear 11 is given an eye-mark (not shown) to show a constant relation of gearing phase of the gear 2 to the gear 1 when the platen 9 is attached as later mentioned.

The square shaft 14 is rotatably thrust-stopped by stopper rings 16 on the frame 4 at two round portions 14*a* via metal parts 15. A pulley 17 is secured near a round portion 14*a* and is communicated with a motor pulley 19 via a belt 18 so that rotation of an output shaft 20*a* of a motor 20 rotates the pulley 17.

The output shaft 20*a* of the motor 20 is formed with a gear 21 integrally connected with the motor pulley 19. The gear 21 is communicated with a paper feed mechanism 22 including a one directional clutch, and feeds a printing paper 23 in a normal direction during CW rotation of the output shaft 20*a*. During CCW rotation thereof, the gear 21 changes the color of the platen 1 by the CW rotation via the motor pulley 19, the belt 18, the pulley 17, the shaft 14, the gear 11 and the gear 2.

The supporter 10 is connected with a wire 24 by a screw 25, and is laterally moved together with the platen 1 via the wire 24 by rotation of a motor (not shown) which is also used for moving a printing head 26.

When the platen 1 is slided from the left to the right, the printing head 26 slides in the same direction to print on one surface of the paper 23. The attached drawings do not specifically illustate a control mechanism for effectively using an available printing range in the lateral direction of the ink containing body 1*a* of the platen, but in the present embodiment, the platen 1 has a delayed moving speed relative to the speed of the printing head 26, whereby the impact position of the printing head 26, at printing, is deviated.

That is, when the printing head 26 is positioned ready for printing at the leftmost end of the available printing range, the leftmost of the available range of the ink containing body 1*a* faces toward the pointed end of the printing head 26. When the printing head 26 is positioned at the rightmost end of the available range, the rightmost end of the ink containing body 1*a* faces toward to the pointed end of the printing head 26.

A further reference will be made to actuation of the embodied device according to the invention.

The platen 1 is set up by mounting the bushings 5 in the grooves 4*a* of the frame, mounting the bosses 1*b* of the platen 1 in the grooves 10*a* of the supporter 10, matching the eye-mark of the gear 2 to the eye-mark of the gear 11 for providing alignment of the rotation phase, and fixing the plate 8 to the frame 4 by the screws 7 while controlling the bush 6. Disassembling is possible by reversing the above, and when the platen body 9 is set up after repairing, and if the lateral feed position and the rotation phase are adjusted in advance, a readjustment is no longer necessary. The platen is mounted in the supporter 10, and said rotation phase may be made by providing said alignment.

Thus, according to the invention, with respect to the printer which is fed with the paper to be printed between the printing head and the platen comprising the ink containing bodies, and carries out the printing by pressure of the printing head, and where the platen is furnished with the plurality of the bodies containing the different inks on its outer circumference and is laterally moved in the same direction as the printing head, and the color is exchanged by rotation control of the platen, the present invention makes the platen and said two control systems divisible, so that one set of the platen is exchanged independently of the two control systems and without disassembling the readjusting thereof.

It will be understood that each of the elements described above, or two or more together, may also find a useful application in other types of printers differing from the types described above.

While the invention has been described and illustrated in a printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claim:

1. An attaching device for a platen body of a printer of the type in which the platen body having two ends is mounted on a platen shaft and arranged opposite to a printing head and the platen shaft is extended between two spaced frames and the platen body has ink containing elements of different colors of the ink and is shiftable along the platen shaft together with the printing head while the platen body is rotatable about the platen shaft for changing a color of printing with a printing paper being transported between the printing body and the printing head so that the printing head may hit the platen body via the printing paper, the attaching device comprising:

(a) a guide shaft (14) extended in parallel with said platen shaft between said spaced frames and being rotatable;

(b) guide means (10) including a U-shaped guide member mounted on said guide shaft and being shiftable therealong, said U-shaped guide member having a pair of arms arranged opposite to each other and engaging said two ends of said platen body, each of said arms having an end formed with a first groove (10*a*) opened at said end of each arm, said platen shaft being received in one of said grooves at each end of said platen body;

(c) a gear (2) secured to one end of said platen body; and (d) a drive gear (11) mounted on said guide shaft for rotation therewith and connected to one arm of said U-shaped guide member, said drive gear engaging said gear secured to one end of said platen body;

(e) each of said frames having a second groove (4*a*), said second groove being opened at one end thereof, said platen shaft being received also in said second grooves.

2. The attaching device as defined in claim 1, further comprising stopper means (8) secured to each of said frames at each opened end of a respective second groove for preventing said platen shaft from slipping out from each of said second grooves.

3. The attaching device as defined in claim 1, wherein said guide shaft is of square shape.

* * * * *